US005879120A

United States Patent [19]

Jakobsen

[11] Patent Number: 5,879,120

[45] Date of Patent: Mar. 9, 1999

[54] METHOD OF SEAMING A CIRCULAR COVER PANEL ONTO THE BODY OF A CAN

[75] Inventor: Hans Jørgen Graa Jakobsen, Hornsyld, Denmark

[73] Assignee: Glud & Marstrand A/S, Losning, Denmark

[21] Appl. No.: 930,383

[22] PCT Filed: Mar. 29, 1996

[86] PCT No.: PCT/DK96/00132

§ 371 Date: Sep. 29, 1997

§ 102(e) Date: Sep. 29, 1997

[87] PCT Pub. No.: WO96/30270

PCT Pub. Date: Oct. 3, 1996

[30] Foreign Application Priority Data

Mar. 30, 1995 [DK] Denmark ..... 0340/95

[51] Int. Cl.[6] ..... B21D 51/44; B65D 17/34

[52] U.S. Cl. ..... 413/12; 413/2; 413/27; 413/67; 220/270

[58] Field of Search ..... 413/12, 2, 4, 8, 413/27, 26, 37, 35, 31, 43, 67, 56; 220/269, 270, 273, 276, 266

[56] References Cited

U.S. PATENT DOCUMENTS

| | | | |
|---|---|---|---|
| 3,198,155 | 8/1965 | Fraze | 413/8 |
| 3,543,961 | 12/1970 | Kennedy et al. | 220/270 |
| 3,795,340 | 3/1974 | Hougen et al. | 220/270 |
| 3,964,632 | 6/1976 | Bozek | 220/270 |
| 4,685,849 | 8/1987 | La Barge et al. | 413/12 X |

FOREIGN PATENT DOCUMENTS

| | | |
|---|---|---|
| 2100243 | 7/1971 | Germany . |
| 364 484 | 2/1974 | Sweden . |

*Primary Examiner*—James F. Coan
*Attorney, Agent, or Firm*—Scully, Scott, Murphy & Presser

[57] ABSTRACT

A method of seaming a circular cover panel (1) provided with a turnable pull ring (2) onto the body of a can. The cover panel comprises a circumferential score line (5) as close as possible to the rim portion (6) of said panel. The pull ring (2) on the cover panel used is mounted in a non-radial position on said cover panel (1) with the result that a clearance (a) is provided between the rim portion (6) of the cover panel and the nose (3) of the pull ring, and a clearance (b) is provided between the rim portion (6) of the cover panel and the handle part (2) of the pull ring. As a result, a closing chuck can be inserted in these clearances (a, b) during the seaming of the cover panel. In this manner the seaming operation is very simple and very rational because it is not necessary to use a particular closing chuck, and because the cover panel need not be angularly positioned on the seaming machine before the closing chuck and the cover panel are moved towards each other.

4 Claims, 1 Drawing Sheet

METHOD OF SEAMING A CIRCULAR COVER PANEL ONTO THE BODY OF A CAN

TECHNICAL FIELD

The invention relates to a method of seaming a circular cover panel provided with a turnable pull ring onto the body of a can, whereby said cover panel comprises a circumferential score line accommodated as close as possible to rim portion of said panel.

BACKGROUND ART

A circular can with a pull ring is known, where said pull ring is placed radially on the cover panel, the nose of said pull ring being positioned adjacent a score line provided close to the rim portion of the cover panel. Such a positioning of the pull ring and its nose is not totally satisfactory because the closing chuck necessary for seaming the cover panel onto the body of the can cannot be provided with a constant outline. The closing chuck must be provided with a recess or perforation in front of the nose. Here it is assumed that the closing chuck is joined with the cover panel very close to the rim portion of said cover panel in such a manner that it can provide a support for an exterior seaming equipment. A closing chuck of a varying cross section along its entire circumference has inter alia the result that when placed on the cover seaming machine the individual cover panels are positioned very accurately. In other words, the pull ring must be positioned in front of a very specific location on the chuck when the seaming procedure is initiated, which is a very complicating factor. It would be much easier for the operator during the positioning of the can if he did not have to consider the pull ring.

BRIEF DESCRIPTION OF THE INVENTION

The object of the present invention is to provide a method of the above type, which is far more simple and less expensive than the known method because it is possible to use a closing chuck of a uniform cross section along its entire circumference.

The method according to the invention is characterised in that the pull ring on the cover panel used is mounted on said cover panel in a non-radial position, whereby both a clearance between the rim portion of the cover panel and the nose of the pull ring and a clearance between the rim portion of the cover panel and the handle part of the pull ring are provided in such a manner that a closing chuck can be inserted in said clearances during the seaming of the cover panel. The resulting seaming operation is very simple and rational partly because a penetration or recess is completely avoided in the closing chuck and partly because the cover panel need not be angularly positioned on the seaming machine before said closing chuck is lowered onto said cover panel.

According to the invention the clearance at the nose may be of a width of 0.5 to 1.5 mm, such as 1.0 mm, while the clearance at the handle part may be of a width of 8 to 12 mm, such as 10 mm. This turned out to be particularly advantageous.

Furthermore, the longitudinal axis of the pull ring may according to the invention in the non-radial position on the cover panel form an angle $\alpha$ with radius to the centre of rotation of the pull ring, $\alpha$ being in the range 18 to 25°, such as approximately 22°. In this manner advantageous clearances are obtained at the pull ring in question.

The invention relates also to a can with a cover panel and a body, where the cover panel is mounted by the method according to the invention.

BRIEF DESCRIPTION OF THE DRAWINGS

The invention is explained in greater details below with reference to the accompanying drawings, in which.

BEST MODE FOR CARRYING OUT THE INVENTION

Figure 1:
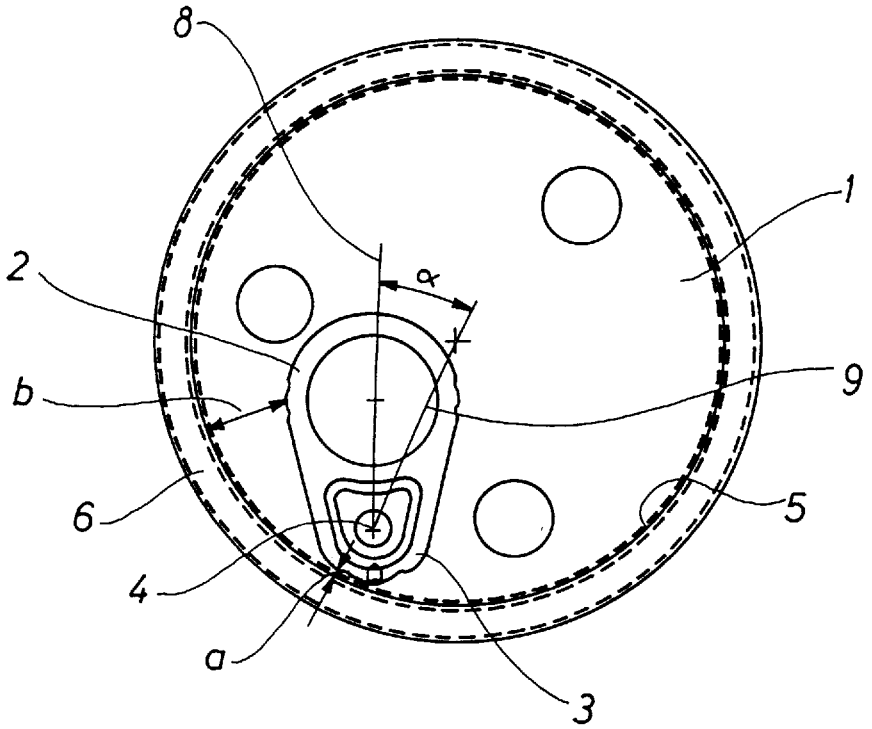
FIG. 1 is a top view of a circular cover panel to be used by the method according to the invention.

The cover panel 1 of FIG. 1 has been prepared for use by the method according to the invention. A pull ring 2 with a nose 3 is riveted on the cover panel 1. The pull ring 2 and the nose 3 can turn about the hollow rivet 4 and are accommodated in a non-radial position on the cover panel. By "non-radial position" is meant that the longitudinal axis 8 of the pull ring 2 forms an angle $\alpha$ with radius 9 to the centre of the rivet 4. The nose 3 is placed adjacent a circumferential score line 5 in the cover panel 1.

As illustrated, a clearance a exists between the rim portion 6 of the cover panel and the nose 3, and a clearance b exists between the rim portion 6 of said cover panel and the handle part 2 of the pull ring. As a result, it is possible to use a closing chuck of a uniform cross section along its entire circumference when the cover panel is to be seamed onto the body of a can by means of such a closing chuck, which is temporarily joined with the cover panel inside the rim portion 6. Furthermore, it is no longer necessary to angularly position the cover panel when the latter is to be mounted on a body of a can in a seaming machine, i.e. it is no longer necessary to position the cover panel in such a manner that the pull ring is pointing in a specific direction.

Figure 2:
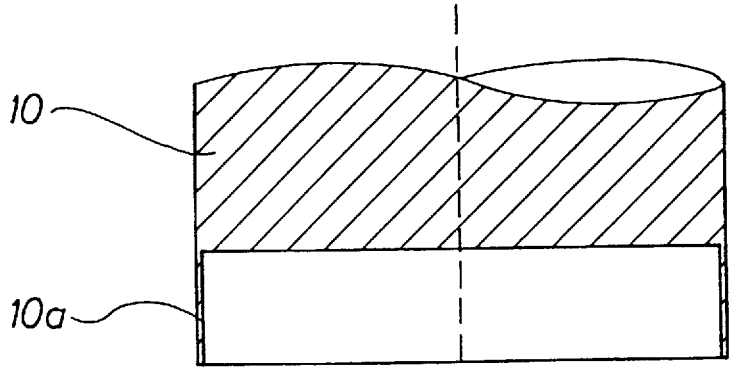
FIG. 2 is a cross-sectional view of a closing chuck used by the method according to the invention.

FIG. 2 is a cross sectional view through a closing chuck 10 to be used by the method according to the invention. The cross section is uniform all along the circumference. The clearance a at the nose 3 is measured radially on the cover panel and can be of a width of 0.5 to 1.5 mm, such as 1.0 mm. The clearance b at the handle part 2 is measured radially on the cover panel and can be of a width of 8 to 12 mm, such as 10 mm. The thin portion 10*a* of the closing chuck is inserted in the clearances a and b when said closing chuck is joined with the cover panel during the seaming procedure.

The above angle $\alpha$ between the longitudinal axis 8 of the pull ring and radius to the centre of the rivet 4 can be in the range 18 to 25° and be for instance approximately 22°.

The present patent application protects also a can with a cover panel and a body, where said cover panel is mounted by the method according to the invention.

The invention may be modified in many ways without thereby deviating from the scope thereof.

I claim:

1. A method of seaming a circular cover panel (1) provided with a pull ring (2) onto the body of a can, said cover panel comprising a circumferential score line (5) as close as possible to the rim portion (6) of said panel, characterised in that the pull ring (2) on the cover panel used is mounted in a non-radial position on said cover panel (1), whereby both a clearance (a) between the rim portion (6) of the cover panel and the nose (3) of the pull ring and a clearance (b) between the rim portion (6) of the cover panel and the handle part (2) of said pull ring are provided in such a manner that a closing chuck can be inserted in said clearances (a, b) during the seaming of said cover panel.

2. A method as claimed in claim 1, characterised in that the clearance (a) at the nose (3) is of a width of 0.5 to 1.5 mm, such as 1.0 mm, whereas the clearance (b) at the handle part (2) is of a width of 8 to 12 mm, such as 10 mm.

3. A method as claimed in claim 1 or 2, characterised in that the longitudinal axis (8) of the pull ring (2) in the non-radial position on the cover panel (1) forms an angle $\alpha$ with the radius (9) to the point of rotation (4) of the pull ring, $\alpha$ being in the range 18 to 25°, such as approximately 22°.

4. A can with a cover panel and a body, whereby the cover panel is mounted by the method according to claim 1.

* * * * *